United States Patent [19]

Scrudato

[11] Patent Number: 4,580,495

[45] Date of Patent: Apr. 8, 1986

[54] PRINTING DEVICE WITH DISPOSABLE CARTRIDGE

[75] Inventor: Frederick Scrudato, Florham Park, N.J.

[73] Assignee: Finest Marking Supplies, Inc., Livingston, N.J.

[21] Appl. No.: 736,399

[22] Filed: May 20, 1985

Related U.S. Application Data

[63] Continuation of Ser. No. 553,624, Nov. 21, 1983, abandoned.

[51] Int. Cl.[4] ..... B41F 5/24; B41F 31/24

[52] U.S. Cl. ..... 101/330; 101/364

[58] Field of Search ..... 101/327, 328, 329, 330, 101/331, 333, 349, 350, 207–210, 148, 364; 118/260, 264, 270

[56] References Cited

U.S. PATENT DOCUMENTS

| | | | |
|---|---|---|---|
| 58,829 | 10/1866 | Howard et al. | 118/270 |
| 1,231,759 | 7/1917 | Lindemann | 101/330 |
| 1,974,650 | 9/1934 | Harban et al. | 118/270 X |
| 2,299,242 | 10/1942 | Lui | 101/328 |
| 2,386,965 | 10/1945 | Lui | 101/108 |
| 2,776,620 | 1/1957 | Quimby | 101/328 |
| 3,260,193 | 7/1966 | Mann | 101/329 |
| 3,654,863 | 4/1972 | Hill et al. | 101/330 |
| 3,662,682 | 5/1972 | Marozzi | 101/330 X |
| 3,797,390 | 3/1974 | Marozzi | 101/333 |
| 4,023,490 | 5/1977 | Marozzi | 101/328 |
| 4,058,085 | 11/1977 | Yang | 118/264 |
| 4,145,967 | 3/1979 | Marozzi | 101/328 |

*Primary Examiner*—J. Reed Fisher

*Attorney, Agent, or Firm*—Ronald G. Goebel

[57] ABSTRACT

The invention provides an apparatus for printing indicia on a substrate which includes a frame assembly having a print roller, a transfer roller in rotational engagement therewith and a fountain roller in rotational engagement with the transfer roller. A bracket member is mounted on the frame assembly for retaining a disposable ink cartridge at the fountain roller, the disposable ink cartridge being mounted in the bracket. The disposable ink cartridge has a top, an upwardly recessed bottom and contains an ink absorbing material such as a sponge.

2 Claims, 7 Drawing Figures

FIG. 6
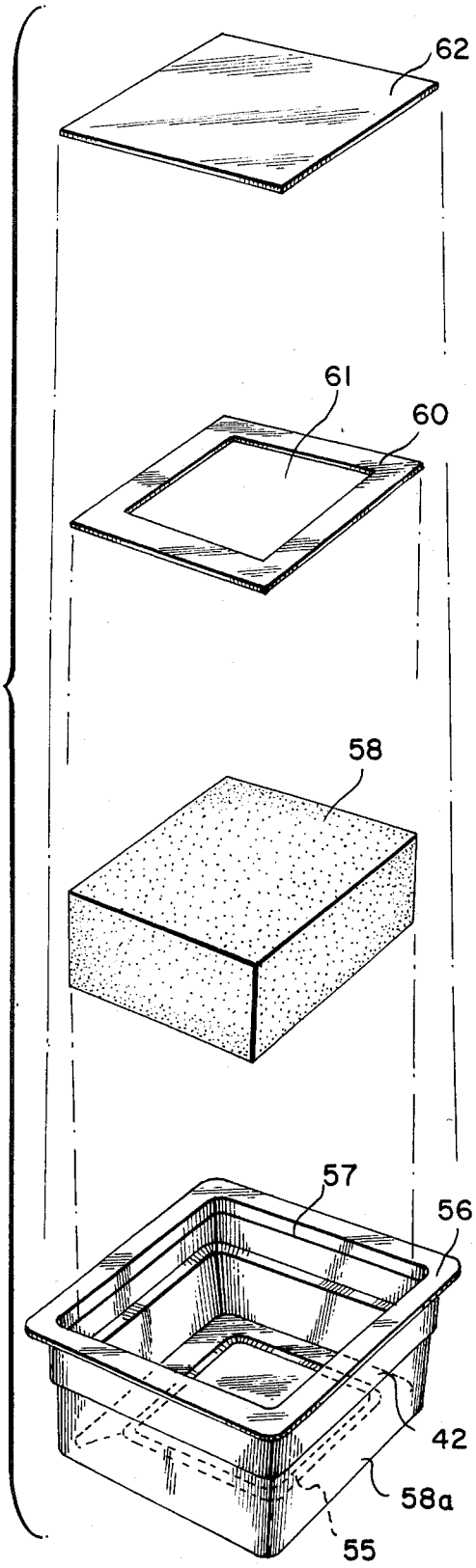
FIG. 5
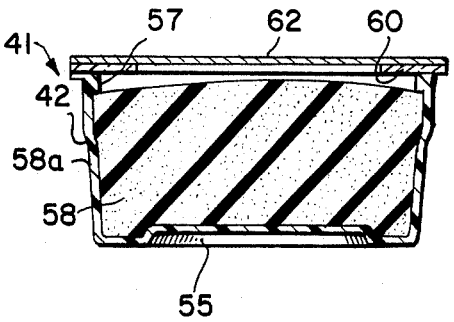
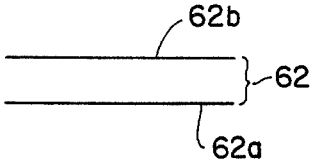
FIG. 7

PRINTING DEVICE WITH DISPOSABLE CARTRIDGE

This is a continuation of application Ser. No. 553,624, filed Nov. 21, 1983, now abandoned.

BACKGROUND OF THE INVENTION

This invention is concerned with a device for printing indicia on substrates having associated therewith a disposable ink cartridge.

Flexographic code dating machines are constant motion marking devices which continuously print certain indicia in ink on a substrate such as a web used ultimately in the packaging of goods. Such machines generally include a frame assembly having a mounting shaft which allows the machine to be mounted to a web feeding machine. The frame assembly has rotatably mounted thereon a free spinning print wheel or cylinder which on its periphery carries the indicia to be printed. The web, traveling below the frame, engages the print wheel and rotates it to effect the printing. Adjacent the print wheel on the frame assembly is a transfer roller which contacts the print wheel. Adjacent the transfer roller is a fountain roller which is also in contact with the transfer roller. The fountain roller contacts a supply of ink from an ink source and transfers ink adhering to its surface to the transfer roller which in turn deposits ink on the indicia of the print wheel. The print wheel then imprints the indicia on the moving web.

In the past, the ink source for use with constant motion marking devices consisted of a housing or reservoir containing a supply of ink in which the fountain roller was immersed. These reservoirs had to be refilled with an ink supply after it was expended. Other containers protruded through the housing and were equipped with an ink absorbent sponge material which contacted the fountain roller. These prior ink sources have several drawbacks. Refilling a used cartridge with ink is a tedious and messy operation often causing the user to contaminate his hands and clothes with ink. The refilling operation is also time consuming. If replacement ink cartridges are used filled with ink and stored for later use it was found that the solvent carrier for the ink would evaporate from the cartridge due to inadequate sealing.

The present invention, on the other hand, provides a constant motion printing device having associated therewith a disposable ink cartridge. The preferable cartridge contains an ink absorbent pad and a sealing means which allows storage of the ink filled cartridge indefinitely without danger of evaporation. This combination allows the user to operate the printer with very little interruption for regenerating the ink supply, to change ink supplies quickly and without spillage and to store cartridges without concern of ink evaporation.

SUMMARY OF THE INVENTION

The present invention comprises a constant motion printing device having a print roller for printing indicia on a moving web, a transfer roller in rotational engagement therewith and a fountain roller in rotational engagement with the transfer roller, means for mounting a disposable ink cartridge to the printing device to provide an ink supply for the fountain roller and a disposable ink cartridge.

A disposable ink cartridge useful in the invention consists of a box-like container having an upwardly recessed bottom and containing an ink absorbing material which will contact the fountain roller. A leak preventive member having a central aperture is preferably sealed to the top of the cartridge, the central aperture allowing access to the ink absorbing material by the fountain roller. A heat sealable laminated cover is also heat sealed over the cartridge to prevent evaporation of ink from the cartridge during storage.

BRIEF DESCRIPTION OF THE DRAWINGS

FIG. 5 is a cross-sectional view of a disposable cartridge useful in the invention;

FIG. 6 is an exploded view of the cartridge of FIG. 5; and

FIG. 7 shows the layers of a heat sealable laminated cover for a disposable ink cartridge.

DETAILED DESCRIPTION OF THE PREFERRED EMBODIMENTS

Figure 1:
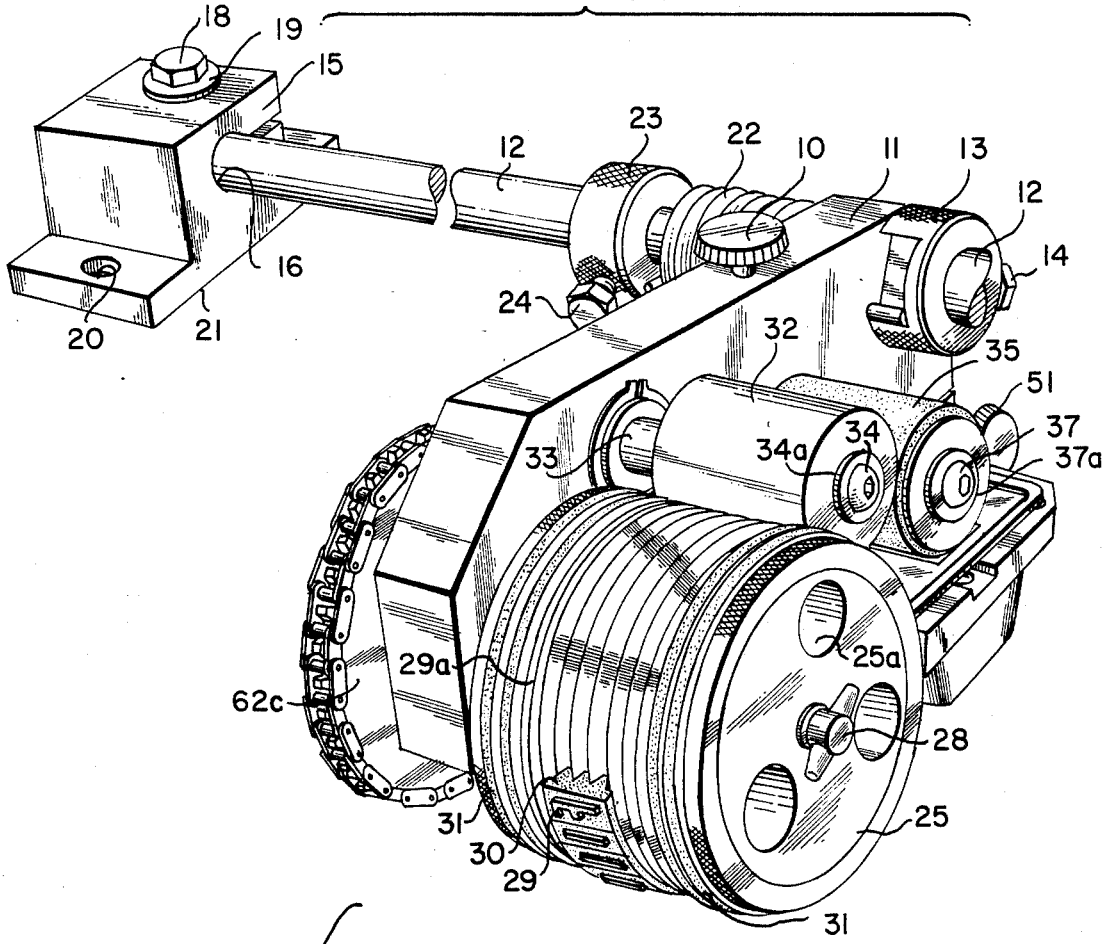
FIG. 1 is a perspective view of the apparatus of the invention.
Figure 3:
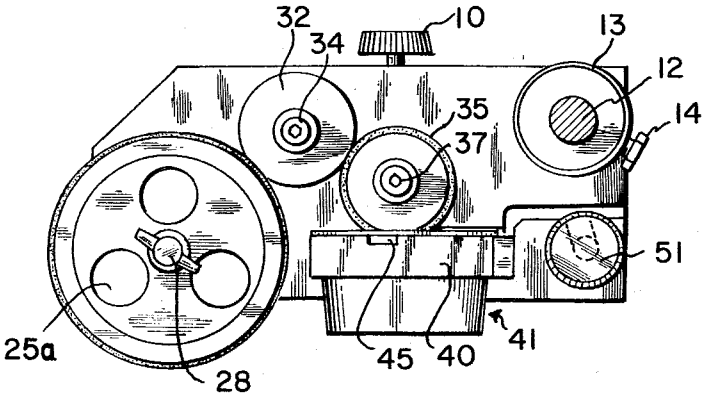
FIG. 3 is an end view of the apparatus.
Figure 2:
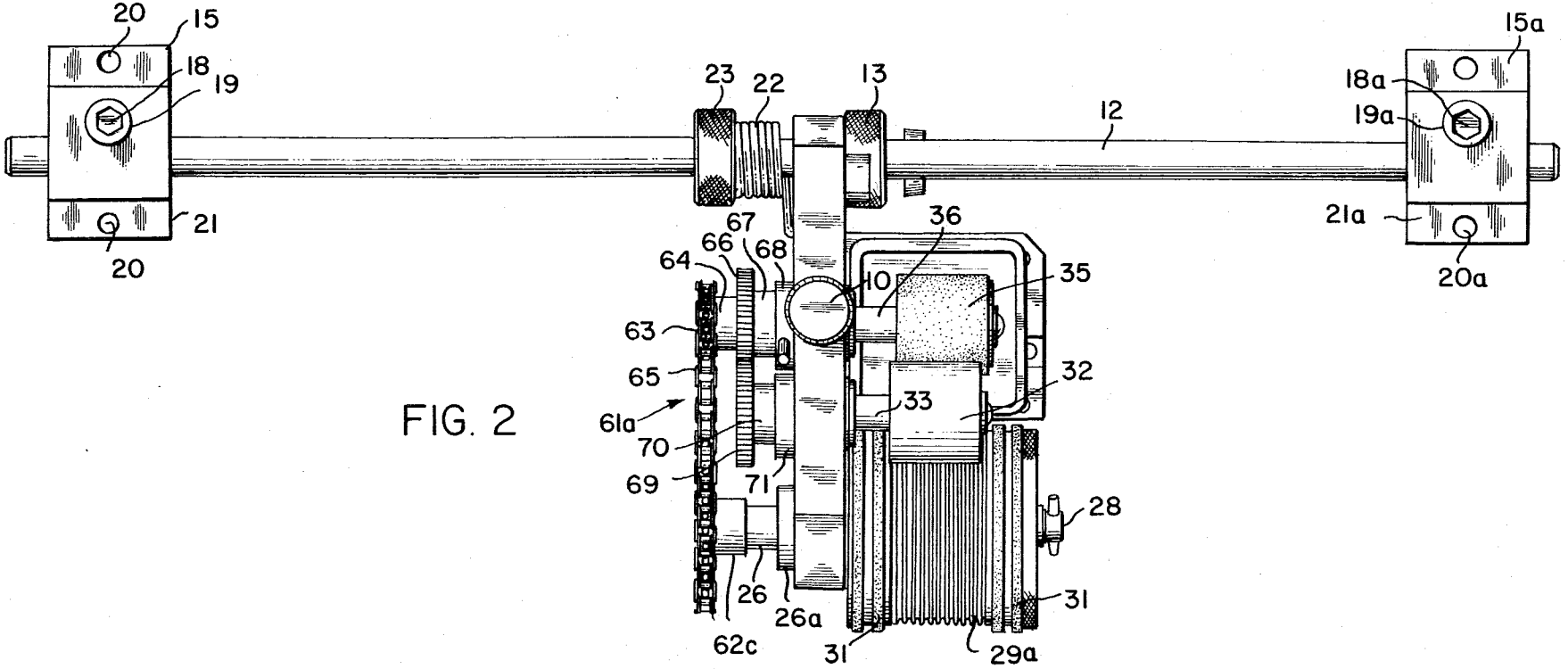
FIG. 2 is a top view of the apparatus.

Referring particularly to FIGS. 1, 2 & 3 the apparatus of the invention is shown consisting of a frame assembly 11 having a plurality of rollers or cylinders which will be described in more detail hereafter. A mounting shaft 12 extends through the frame assembly and is clamped on the roller side of the frame by end clamp 13 having bolt 14 threaded therein, the end of which bolt threadably impinges on the shaft 12. The shaft, at one end, is clamped to a mounting bracket 15 in a cylindrical opening 16 formed therein, which opening can be slightly adjusted in size by expanding or contracting elongated slot 17 communicating with the opening. Adjustment bolt 18 having washer 19 is threadably mounted in the mounting bracket and extends across the slot. Tightening or loosening of such bolt will secure or unsecure the shaft to the bracket. A pair of mounting holes 20 are located in flat wing portions 21 of the bracket to allow the bracket to be fastened to a web feeding machine in which web the apparatus will imprint indicia. Similarly, the shaft is connected at its other end to mounting bracket 15*a* in the same manner as bracket 15 wherein like parts in 15*a* are designated by the same numeral as 15 plus the letter "a".

A circular spring 22 is disposed about the shaft on the side of the frame assembly opposite the rollers. Intermediate clamp 23 having adjusting nut 24 which is engageable with the shaft 12 is set and tightened against the spring to exert tension in the axial direction of the shaft. This tension is in turn transmitted to the frame assembly and end clamp 13, the result being that the frame assembly is urged in a downward direction but is able to be moved somewhat in the vertical direction. If tension is eased on the spring this movement is facilitated. This tension allows the frame to adjust to a moving and undulating web passing under the print roller 25. Knob 20*a* is threadably mounted on the top of the frame to allow the user to lift or move the apparatus.

The print roller 25 is rotatably mounted at the forward end of the frame assembly on print roller shaft 26 which is secured to the frame assembly by wing nut 28. The print cylinder engages the substrate web moving therebelow. The print roller comprises a metal cylinder having lightening holes 25*a* therein. The outside surface is comprised of a rubber or plastic material having a plurality of equally spaced channels 29*a* formed in its outer surface. Indicia in the form of print blocks consisting of raised letters 29 numbers or combinations thereof mounted on a backing element 30 having a plurality of spaced protrusions are pressed into engagement with these channels and retained therein. Drive bearers 31 made of a material such as hard rubber for example are located at the inner and outer portions of the print roller and extend outwardly from the periphery of the roller slightly more than the raised lettering. These drive bearers are the means driven by the web and prevent the print blocks from being dislodged by the moving web.

In contact with the print roller is transfer roller 32 rotatably mounted on transfer roller shaft 33 and secured to the frame assembly and retained on said shaft by bolt 34 and washer 34*a*. In contact with the transfer roller 32 is fountain roller 35 mounted on fountain roller shaft 36 secured to the frame assembly and retained on the shaft by bolt 37 and washer 37*a*.

On the opposite side of the frame assembly to the rollers is shown the roller drive assembly indicated generally by 61*a*. The drive assembly consists of a print roller drive sprocket 62*c* which is press fitted on the end of shaft 26. Shaft 26 passes through collar 26*a* on the same sides of the frame. A fountain roller sprocket 63 is connected with fountain roller shaft 26 through coupler 64. An endless chain 65 connects the two sprockets. A fountain roller toothed gear 66 having connector 67 is also mounted on the fountain roller shaft adjacent to which is adjustable collar 68. A transfer roller toothed gear 69 which engages the fountain roller toothed gear is mounted on transfer roller shaft 33 by means of connector 70. Adjacent the connector is collar 71.

Figure 4:
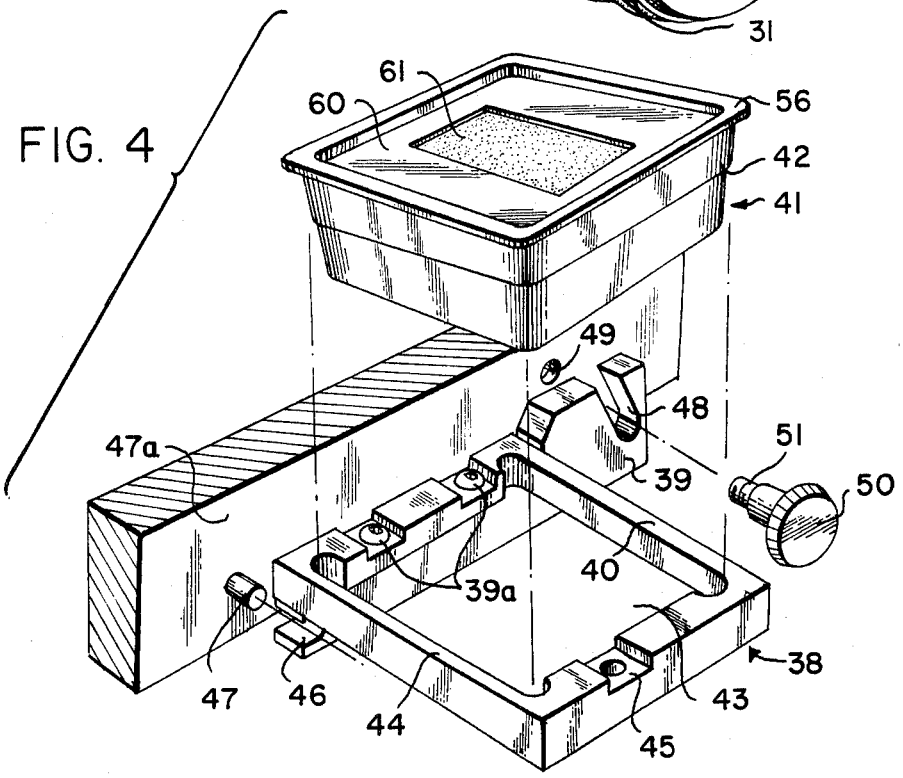
FIG. 4 is a view of the cartridge and cartridge mounting means of the apparatus.

Referring now to FIG. 4 in particular, there is shown generally a cartridge bracket 38 consisting of mounting member 39 and a retaining member 40 for retaining a disposable ink cartridge 41. The cartridge retaining member 40 has a central rectangular opening 43 into which the cartridge 41 is inserted. Flange 56 of the cartridge 41 engages the top of sides 44 of the retaining member when the cartridge is inserted in the member to hold the cartridge in the member (see FIG. 3). Recess 45 in the retaining member allows removal of the cartridge by inserting the finger tip therein and moving the cartridge upward by its shoulder.

The mounting member 39 is mounted to the retaining member by screws 39*a* and has a forward slot 46 through which passes pin 47 protruding from a shaped recess 47*a* in the frame assembly, the shaped recess generally conforming to the shape of the mounting member and retaining member screwed thereto. At the other end of the mounting member is rearward slot 48 which can be aligned with internally threaded hole 49. Knob 50 having externally threaded bolt 51 is inserted through hole 48 and threaded into hole 49 to secure member 39 to the frame. The slots 46 and 48 allows vertical adjustment of the bracket 38 with respect to the fountain roller 35.

Referring particularly to FIGS. 5 & 6, the disposable ink cartridge 41 of FIGS. 1–4 is shown as a box-like container comprised of an injection-molded plastic such as polyethylene having tapered sides 58*a*, an upwardly recessed bottom 55 and a flanged top 56. The top inside portion of the cartridge has formed therein retaining shoulder 57. Ink for marking purposes is placed in the cartridge and an ink absorbing body such as sponge material 58 is inserted in the bottom of the cartridge against the recessed bottom. The sponge is held within the cartridge by the annular retaining shoulder 57 and bulges slightly upward in response to the upward pressure produced in the cartridge by the recessed bottom. The upwardly bulged configuration of the sponge material promotes a pumping action of ink to the sponge material as the fountain roller engages and compresses the sponge material toward the bottom of the cartridge. A leak preventive member 60 having central aperture 61 is heat sealed to the top of the cartridge. This member prevents ink from leaking from the cartridge when the cartridge is tilted from the horizontal and the central aperture allows the fountain roller to contact the sponge material.

A heat sealable laminated cover 62 may be is secured to the flange and top of the cartridge by the application of heat to complete the assembly as shown in FIG. 6. This prevents loss of ink during storage.

FIG. 7 shows the upper and lower layers of the laminated cover 62. The cover 62 comprises a lower layer 62*a* made of metallic foil such as aluminum foil having a heat sealable coating extrusion coated on the undersurface thereof, said coating comprisng a polymeric composition which when heated to temperatures ranging from about 350° F. to 500° F. forms a hermetic peelable heat seal on the flanged top. An upper layer of paper 62*b* such as kraft paper is bonded to lower layer 62*a* by means of an adhesive. The heat sealable laminated cover 62 effectively prevents evaporation and leakage of the solvent carrier of the ink supply. This allows the ink-filled cartridge to be stored prior to use without loss of volatile ink.

Ink from the cartridge 41 is transmitted to the fountain roller, which is rotated by movement of the print roller on the moving web which through the chain and gear connections previously discussed rotates the transfer roller. Ink is transferred from the fountain roller to the transfer roller with which it is in contact and from the transfer roller to the indicia on the print roller. In continuous movement the web is imprinted by the print roller. When the ink supply in the cartridge is exhausted the used cartridge is discarded and a new one replaced in the bracket in a matter of seconds. Cartridges stored for later use will not lose their ink supply through evaporation by virtue of the heat sealed laminated cover.

Any disposable ink cartridge can be used in the invention as long as it contains an ink absorbing member which will contact the fountain roller.

I claim:

1. A constant motion marking device for printing indicia on a substrate comprising:

(a) a frame assembly having rotatably mounted thereon a print roller carrying indicia to be printed, a transfer roller in rotational engagement with said print roller and a fountain roller in rotational engagement with said transfer roller;

(b) a cartridge bracket substantially horizontally mounted on said frame assembly below said fountain roller comprising a vertically adjustable mounting member and a cartridge retaining member secured to said mounting member having a central aperture for releasably retaining a disposable and replaceable ink cartridge containing its own supply of ink therein, said cartridge being self-supported in said cartridge retaining member and upwardly ejectable from said retaining member, said fountain roller engaging said ink cartridge when inserted.

2. The apparatus of claim 1 wherein said disposable and replaceable ink cartridge comprises a top, an upwardly recessed bottom, an ink absorbing material, and a leak preventive member having a central aperture sealed to the top of said cartridge.

* * * * *